US005154037A

United States Patent [19]

Focke

[11] Patent Number: 5,154,037

[45] Date of Patent: Oct. 13, 1992

[54] PROCESS AND APPARATUS OF FEEDING A WEB OF MATERIAL TO A PROCESSING MACHINE, ESPECIALLY A PACKAGING MACHINE

[75] Inventor: Heinz Focke, Verden, Fed. Rep. of Germany

[73] Assignee: Focke & Co., Verden, Fed. Rep. of Germany

[21] Appl. No.: 648,934

[22] Filed: Feb. 1, 1991

[30] Foreign Application Priority Data

Feb. 3, 1990 [DE] Fed. Rep. of Germany ..... 4003192

[51] Int. Cl.[5] ..... B65B 41/16; B65B 57/04; B65H 17/42

[52] U.S. Cl. ..... 53/396; 53/64; 53/389.4; 226/118

[58] Field of Search ..... 53/389.2, 389.4, 389.5, 53/64, 396; 226/118, 119, 111, 934; 493/23, 24, 29, 411, 412, 415

[56] References Cited

U.S. PATENT DOCUMENTS

| | | | |
|---|---|---|---|
| 2,907,565 | 10/1959 | Sauter | 226/118 X |
| 2,927,789 | 3/1960 | Walsh et al. . | |
| 2,960,611 | 11/1960 | Namenyl-Katz | 226/118 X |
| 3,047,195 | 7/1962 | Broderson . | |
| 3,047,198 | 7/1962 | Long . | |
| 3,155,022 | 11/1964 | Schwertz | 226/118 X |
| 3,240,411 | 3/1966 | Zarleng | 226/118 X |
| 3,539,085 | 11/1970 | Anderson et al. | 226/111 X |
| 3,946,921 | 3/1976 | Noguchi . | |
| 3,970,489 | 7/1976 | Schmidt et al. . | |
| 4,561,581 | 12/1985 | Kelly | 226/118 X |
| 4,589,580 | 5/1986 | Young, Jr. et al. . | |
| 4,591,084 | 5/1986 | Balian et al. | 226/118 |
| 4,719,855 | 1/1988 | Cannon et al. . | |
| 4,940,500 | 7/1990 | Tadokoro et al. | 493/415 X |
| 4,943,271 | 7/1990 | Focke et al. | 493/410 X |
| 4,986,803 | 1/1991 | Focke et al. | 493/410 X |

FOREIGN PATENT DOCUMENTS

| | | |
|---|---|---|
| 1412593 | 8/1965 | France . |
| 1405286 | 9/1975 | United Kingdom . |
| 1465612 | 2/1977 | United Kingdom . |
| 2144399 | 3/1985 | United Kingdom . |

*Primary Examiner*—Horace M. Culver
*Attorney, Agent, or Firm*—Sughrue, Mion, Zinn, Macpeak & Seas

[57] ABSTRACT

A process for controlling the drive of a reel of a continuous web of material which is fed to a processing machine (packaging machine). The web of material forms a material reservoir upstream of the processing machine. The invention is based on the object to improve this process such that the reel can be driven as continuously as possible for refeeding material into the material reservoir. For this purpose, the filling of the material reservoir is (continuously) determined and the drive of the reel is driven in dependence on the reservoir filling, such that the filling does not fall below a minimum filling and does not exceed a maximum filling. The reservoir filling is preferably determined by comparing the reservoir outflow with the reservoir inflow as well as by a more direct method, preferably by an optical scanning or weighing. The invention further relates to a feed apparatus for conducting this process.

14 Claims, 8 Drawing Sheets

PROCESS AND APPARATUS OF FEEDING A WEB OF MATERIAL TO A PROCESSING MACHINE, ESPECIALLY A PACKAGING MACHINE

BACKGROUND OF THE INVENTION

The invention relates to a process for controlling the drive of a reel of a continuous web of material, preferably a web of packaging material, from which blanks are successively severed and fed to a processing machine s especially a packaging machine or a folding unit (folding turret) thereof, said web of material forming a material reservoir.

The invention further relates to an apparatus for feeding a web of material to a processing machine, said apparatus having a motor for driving a reel of the web of material to unwind the latter off the reel and having a (web of) material reservoir, through which the (wound off) web of material can be conveyed, in particular for conducting said process.

In the abovesaid apparatus or process, the feeding of the web of material to the processing machine can be problematic, since the processing machine, especially a packaging machine, is usually run at different operating states which often and quickly alternate with one another. Different operating states of the machine may be for instance standstill, normal operation, (short-time) overspeed operation or (short-time) crawling speed.

In spite of these alternating operating states of the processing machine, the latter still has to be sufficiently supplied with material in each of the operating states. In principle, a sufficient supply of material can be ensured by providing a material reservoir as a buffer between the reel and the processing machine. Depending on the holding capacity of the material reservoir, the reel can react to the momentary requirement of the machine with a certain delay and (re)fill the material reservoir as required.

Nevertheless, even with a material reservoir being provided, the reel still has to follow the operating states of the downstream machine, although possibly with a delay.

This is particularly problematic, if the reel is heavy and needs relatively large accelerations for changing the operating states. The heavy reel has an inertia of masses which makes a direct reaction to the requirements of the machine or the operating states difficult or impossible even if such reaction is delayed.

Heavy reels are particularly used in connection with packaging machines, if for instance packaging material of thin cardboard is to be made into packs. With such packaging processes, it is known in the packaging art to divide the web of material into pack blanks, the individual blanks remaining connected to one another via residual web connections so that they can still be held ready as a web of material on a reel. The blanks are severed from the web of material, for instance by being torn or sheared off, only when they are in the region of the packaging machine. Regarding this state of the art, reference is made to DE-OS 37 16 897, DE-OS 37 35 674 and DE-OS 37 35 675.

In order to bypass or avoid the afore-described problem, caused by the relatively high dead weight of the reel which is to be driven, it is desirable to drive the reel as independently as possible from the operating states of the downstream machine and thus as continuously as possible.

SUMMARY OF THE INVENTION

Consequently, the invention is based on the object to further develop the abovedescribed type of process such that the material reservoir can be refilled with the web of material from the reel in a manner which is as independent as possible from the operating states of the downstream machine and thus as continuous as possible.

According to the invention, this object is attained by (continuously) determining the filling of the material reservoir and by controlling the drive of the reel in dependence on the reservoir filling, such that the filling does not fall below a minimum reservoir filling and does not exceed a maximum reservoir filling.

The control system of the drive as taught by the invention advantageously ensures in a surprisingly simple manner that the reel can be continuously driven to rotate, although possibly at slightly varying velocities but mostly without a interruptions, in order to refill the material reservoir practically independently from the operating states of the downstream machine. Thus, especially a complicated stopping or restarting of the reel can be largely avoided.

In a preferred embodiment, the process as taught by the invention provides that the reservoir filling is measured directly and is (additionally) determined by recording, which amount of material is fed into the material reservoir and which amount of material is taken out of the material reservoir. The reservoir filling may for instance be measured by weighing or measuring the length of web of the web of material being in the reservoir. Preferably, the web of material is fed into the material reservoir in zig-zag shaped layers, such that the reservoir filling may also be measured by determining the amount of layers. Such a zig-zag feed of the web of material is particularly advantageous and easy to conduct with webs of material which are already divided into blanks which are still connected to one another via residual web connections, since there are weakened portions in the region of these residual web connections which facilitate a folding of the web of material.

Determining the reservoir filling on the one hand more indirectly by comparing the inflow and outflow of the reservoir and on the other hand more directly, ensures an optimum control of the reel drive.

In the process as taught by the invention it is preferred that, when the filling falls below a predetermined intermediate reservoir filling value between the minimum and maximum reservoir filling, the outflow from the reservoir is not released or at least the inflow is running faster than the outflow until the reservoir level again exceeds the predetermined intermediate value. This means that the reel is preferably driven at a speed which depends on the filling level of the material reservoir. The reel is kept a rotating, i.e. it is driven continuously, as long as possible, even if the speed may vary. Preferably, the reel is stopped only when the material reservoir is completely filled and there is no discharge from the reservoir. Naturally, certain emergency stop situations such as a tearing of the web of material may also be provided for.

In order to exactly determine the reservoir filling, preferred embodiments employ rollers for feeding the web of material into and discharging it out of the reservoir, the inflowing and outflowing amount of material, particularly the length of the web of material, being determined by recording the rotary movement of the rollers with regard to the circumference of the roller. For this purpose, rotational pulse generators known per se may be used. For example, 1000 pulses may be transmitted by such an rotating pulse generator per one revolution of a roller.

The actual reservoir filling is determined in a more direct manner preferably by means of optical sensors, each layer of the web of material which is zig-zag folded in the reservoir being preferably associated with a pair of sensors. Especially when the material reservoir is designed perpendicularly, a stack of layers is formed by the dead weight of the layers in the material reservoir, such that the upper edge of said stack of layers may if necessary also be determined by a smaller number of sensors.

Alternatively, the reservoir or the reservoir filling may also be weighed, which is particularly suitable if the reservoir is horizontally oriented.

An apparatus according to the invention is characterized by a control system for the motor of the reel, which comprises determining means for determining the reservoir filling and by means of which the motor can be controlled in dependence on the (continuously) determined reservoir filling, such that the reservoir filling does not fall below a minimum reservoir filling and does not exceed a maximum reservoir filling.

Especially the process according to the invention can be conducted by means of such an apparatus according to the invention.

The apparatus according to the invention preferably comprises conveying means for feeding the web of material into and discharging the same out of the reservoir. The movement of these conveying means can be determined in the more indirect way of measuring the reservoir filling. The conveying means are preferably rollers, namely pushing and drawing rollers, with revolution counters or rotational pulse generators as measuring means.

For a more direct way of measuring the actual reservoir filling, sensors can be assigned to the reservoir, preferably optical sensors for scanning layers of the web of material or weighing sensors or weighing members for weighing the complete reservoir filling.

Exemplary embodiments which show further features of the invention are schematically shown in the drawings, in which:

DESCRIPTION OF PREFERRED EMBODIMENTS

Figure 1:
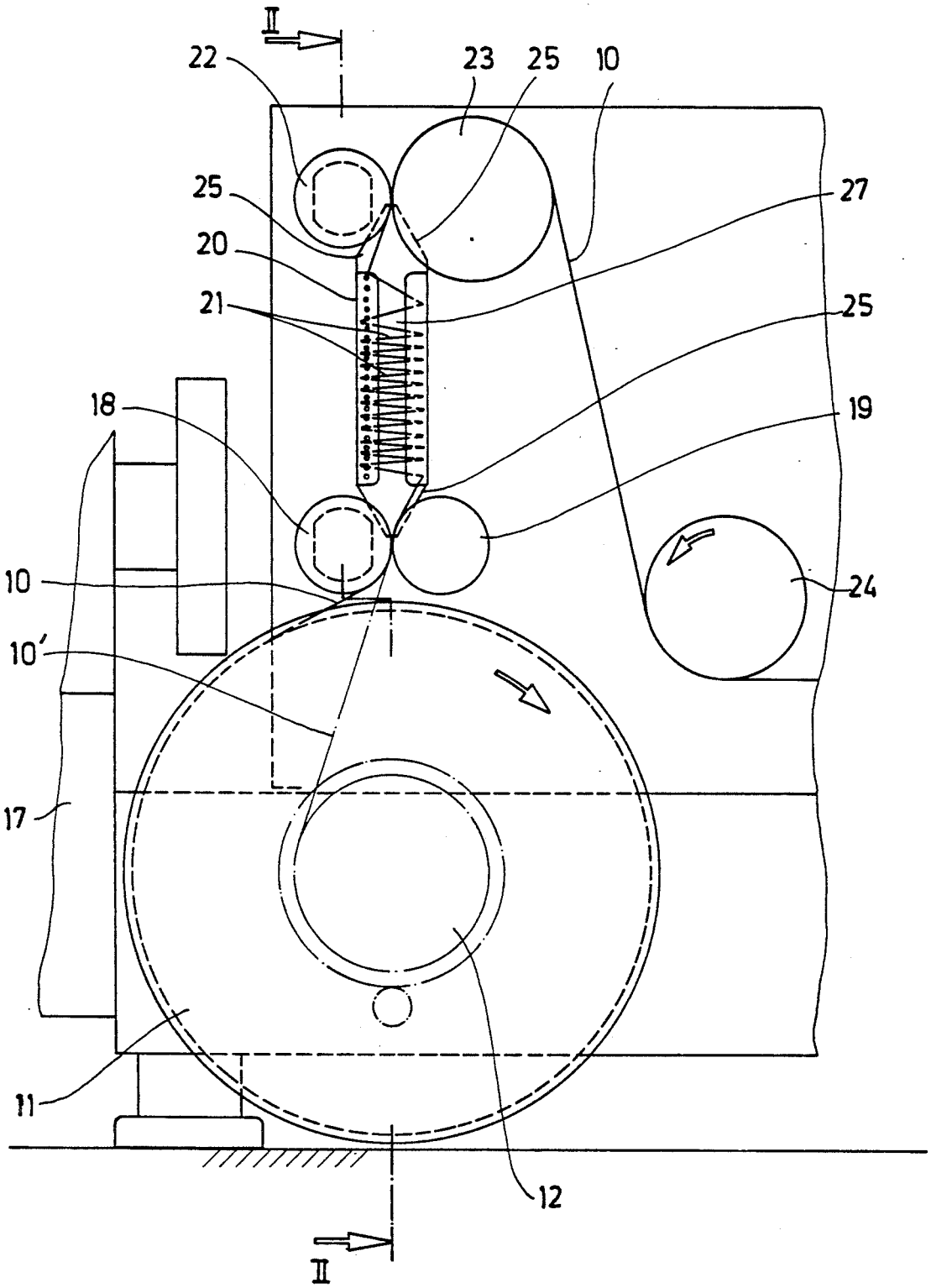
FIG. 1 is a side view of a detail of a feed apparatus according to the invention with a driven reel, conveying rollers and a material reservoir.

FIG. 1 is a side view of a detail of a feed apparatus according to the invention for feeding a web of material, particularly a web of packaging material, to a packaging machine which is not shown.

Figure 2:
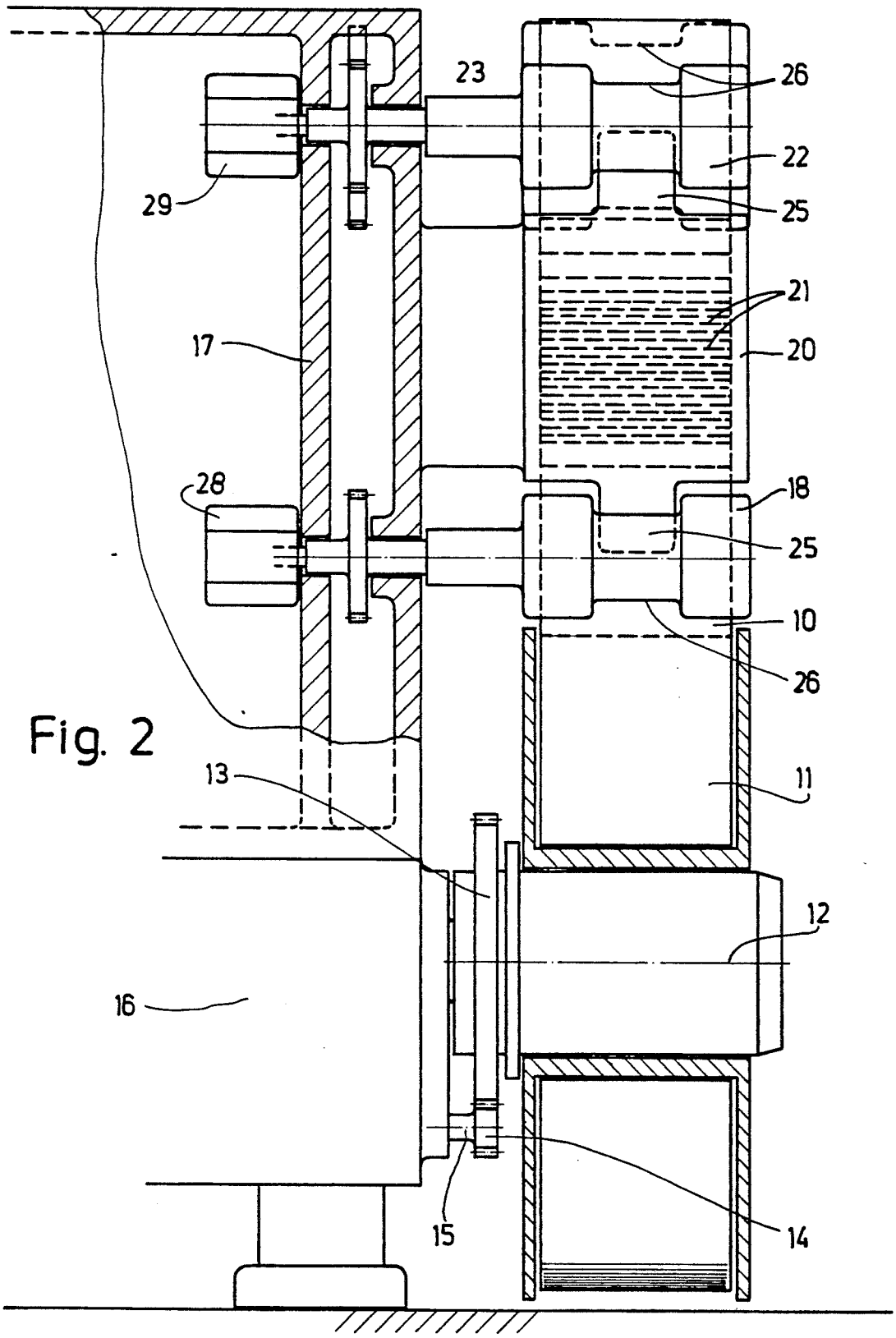
FIG. 2 shows a partial section of the apparatus according to FIG. 1, taken along the dot-dash line II—II of FIG. 1.

The web of material 10 is drawn off a reel 11 which is rotatingly driven via a working journal 12. For its own drive, the working journal has a toothed wheel 13 which is in engagement with a pinion 14 of a shaft 15 of a motor a drive 16 (FIG. 2). The motor drive 16 is arranged on a machine frame 17.

The web of material 10 is drawn off the rotating reel 11 by means of a pair of rollers 18. 19 and pushed into a reservoir housing 20 for a material reservoir of the web of material 10. Here, the driven roller 18 acts as a pushing roller. The roller 19 may be designed as a rotating press-on roller.

The web of material 10 is pushed by the pair of rollers 18, 19 into the reservoir housing 20 in zig-zag layers 21. In the embodiment according to FIG. 1, the reservoir housing 20 is oriented perpendicularly, so that a stack of layers with a distinct upper edge is formed as a result of the dead weight of the layers 21.

For discharging the web of material 10 out of the reservoir housing 20, a pair of drawing rollers 22. 23 is provided. Out of these rollers, roller 22 is a driven drawing roller, while roller 23 is only an idle press-on roller.

The web of material 10 is conveyed further to the packaging machine (not shown) via further conveying means, especially via conveying rollers 24.

The two driven rollers 18 and 22 have rotational pulse generators, via which the rotary movement of these rollers is recorded. Preferably, rotational pulse generators which transmit 1000 pulses per rotation of the roller are employed. By comparing the rotary movements of the two rollers 18 and 22 determined in this way, the reservoir filling of the reservoir housing 22 can be determined. For a more direct additional measuring of the reservoir filling, sensors or measuring means are provided, which will be described in more detail particularly in connection with FIGS. 4 to 6.

The web of material 10 is sketched in FIG. 1 once with a solid line for a nearly full reel and once with a dot-dash a line for a nearly empty reel (reference numeral 10').

The reservoir housing 20 is mainly box-shaped, with the lower and upper end face in the embodiment according to FIG. 1 being open for conveying through the web of material 10. In the region of each of these end faces, the reservoir housing 20 has a pair of runout members 25. These runout members 25 project in the direction of the rollers 18, 19 and 22, 23, respectively, and ensure a secure and exactly guided feed and discharge of the web of material 10.

FIG. 2 shows that the runout members 25 have a tongue-like shape. The rollers 18, 19 and 22, 23 have recesses 26 into which the runout members 25 extend approximately tangential.

In one or in two oppositely situated side walls, the reservoir housing 20 has a continuous slit 27, which extends in the conveying direction of the web of material 10 and through which the layers 21 of the web of material 10 can be viewed while being in the reservoir housing 20.

FIG. 2 also sketches drive means 28 and 29 for the rollers 18 and 22.

Figure 3:
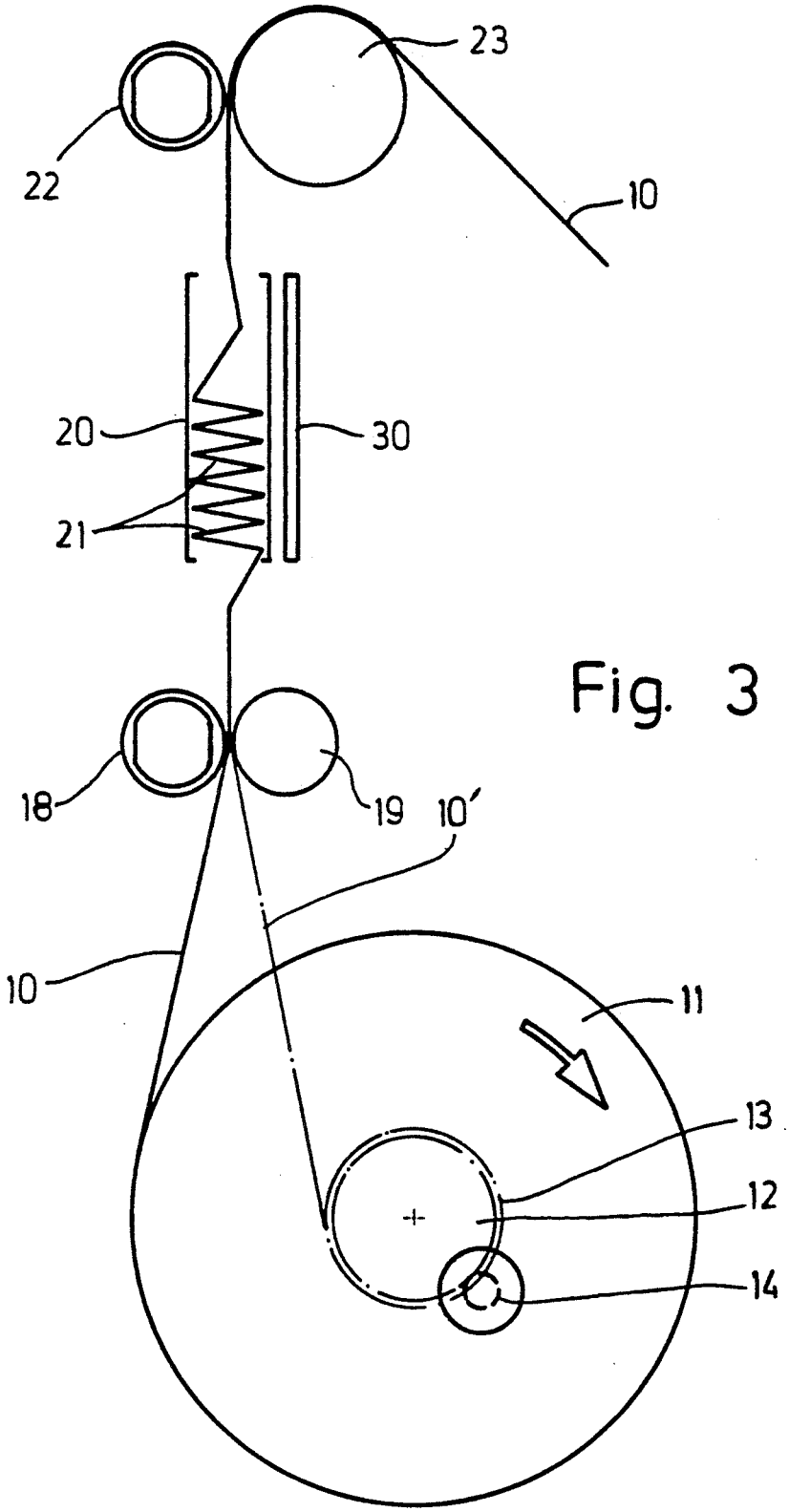
FIG. 3 is a further simplified schematic view of the apparatus according to FIG. 1.

FIG. 3 is a schematic view of an embodiment approximately corresponding to the embodiment of FIG. 1. This representation makes the topology of the feeding of the web of material more clear. The reservoir housing 20 is again arranged mainly perpendicularly and is associated with a measuring means 30 which comprises a row of sensors arranged above one another.

Figure 4:
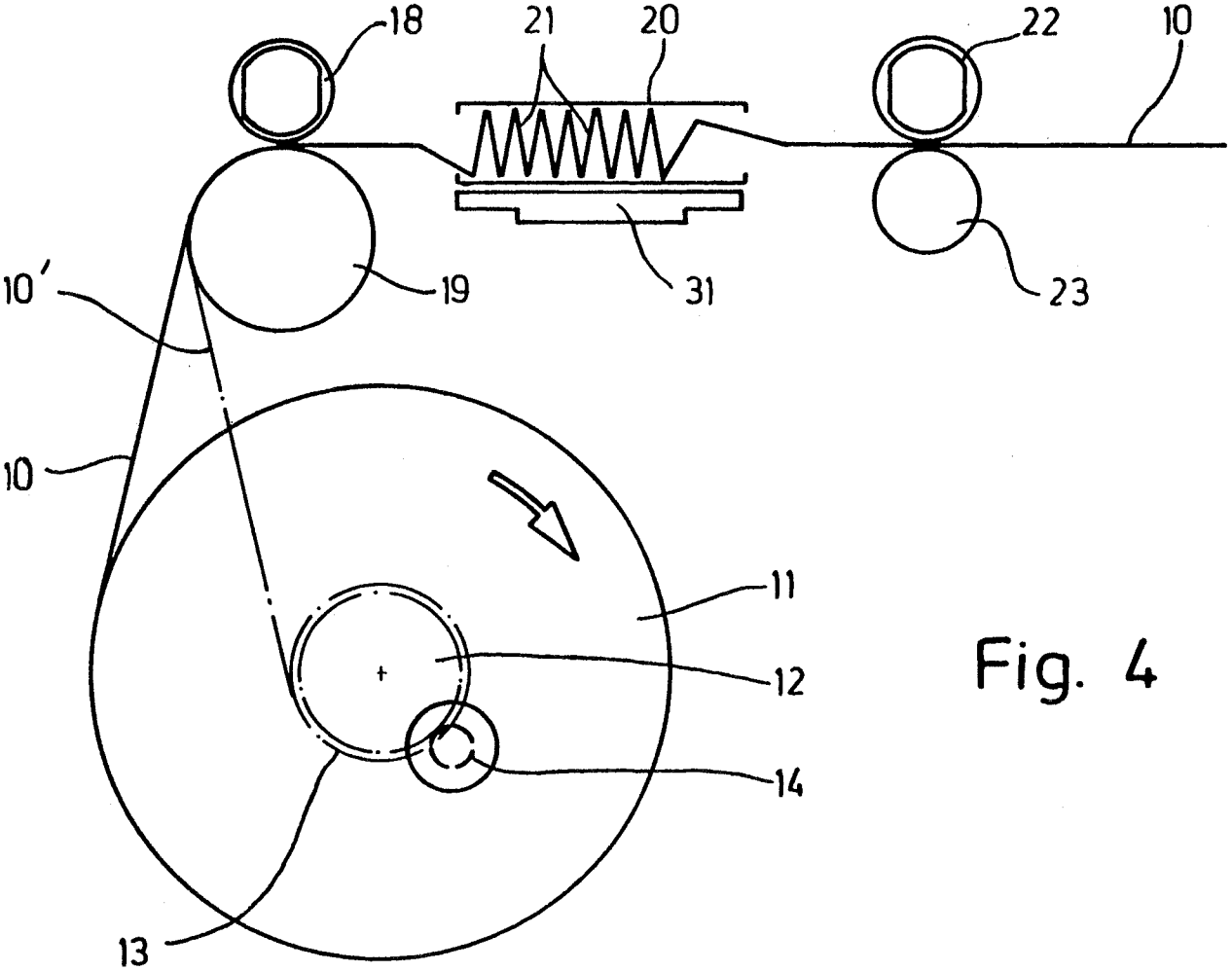
FIG. 4 is a simplified schematic view according to FIG. 3 of a second embodiment of a feed apparatus according to the invention.

FIG. 4 shows a second embodiment of a feed apparatus according to the invention in a schematic view corresponding to the view of FIG. 3. The embodiment of FIG. 4 essentially differs from that of FIG. 3 in that the reservoir housing 20 is arranged horizontally. With this arrangement of the reservoir housing 20, the layers 21 of the web of material 10 do not form a stack of layers with a distinct upper edge in the reservoir housing. This is the reason why a measuring means 31 is assigned to the reservoir housing 20 which comprises a weighing member or device. In this embodiment the reservoir filling is thus measured by weighing.

Figure 5:
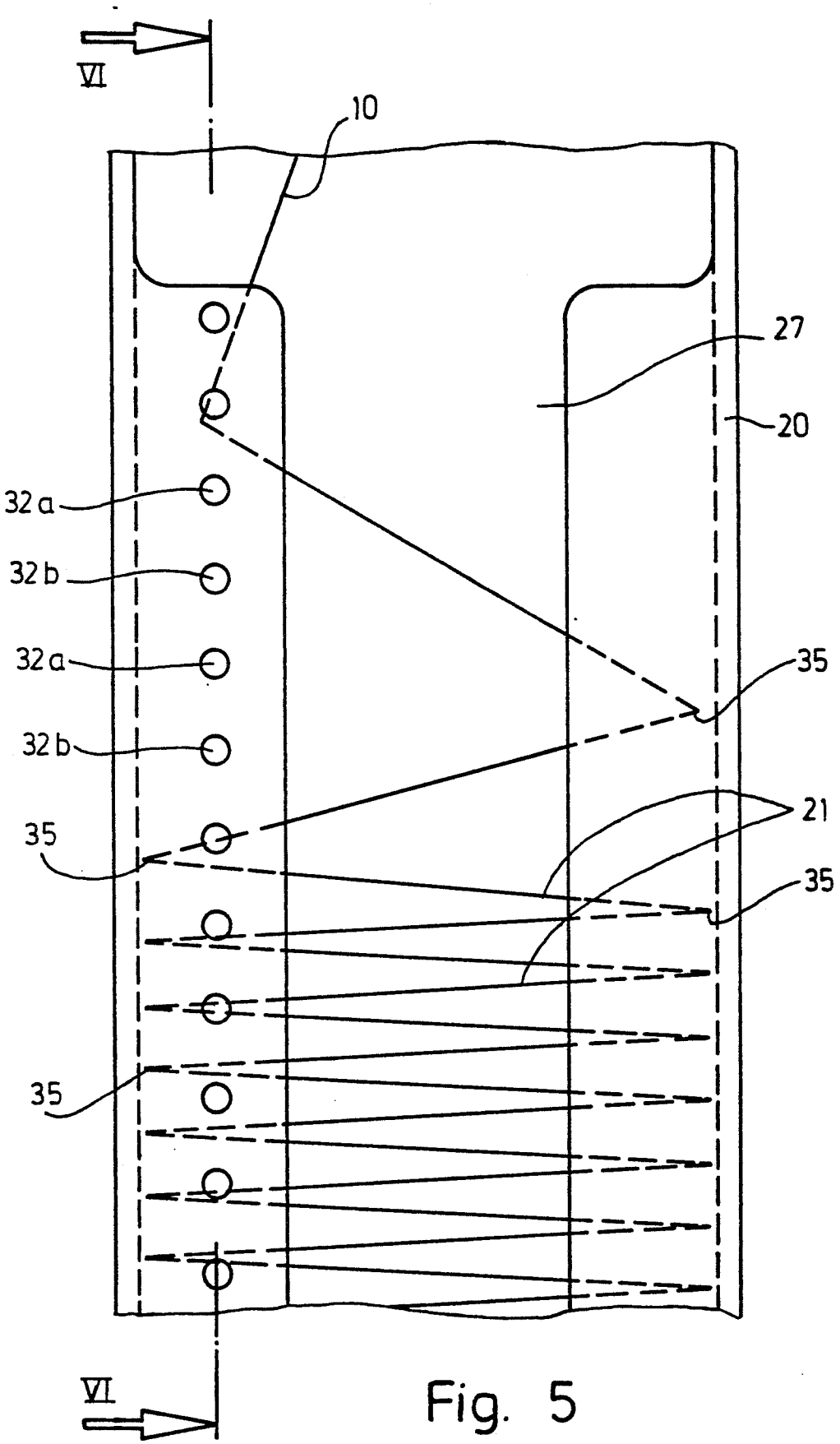
FIG. 5 shows a detail of the material reservoir according to FIG. 1 on an enlarged scale.
Figure 6:
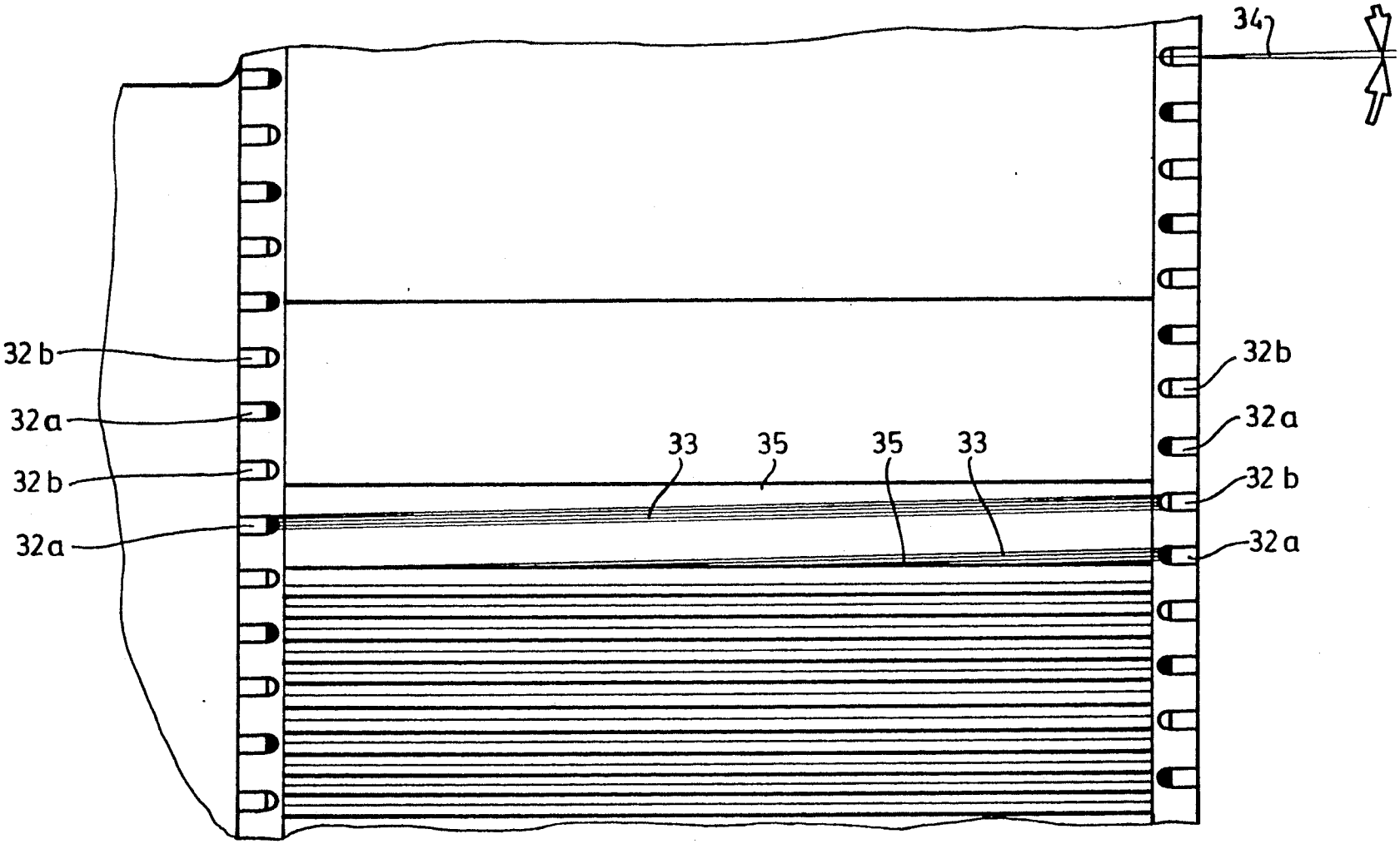
FIG. 6 shows a section of the material reservoir according to FIG. 5, taken along the dot-dash line VI—VI of FIG. 5.

FIGS. 5 and 6 show details of the reservoir housing 20 according to the embodiment of FIG. 1.

A plurality of sensors 32*a* and 32*b* is arranged inside the reservoir housing 20. These sensors 32*a, b* are arranged above one another at a distance approximately corresponding to the distance between two layers 21 of the stack of layers forming in the reservoir housing 20.

In each case, a transmitter 32*a* and a receiver 32*b* are arranged opposite one another, such that the sensors 32*a, b* are slightly offset to one another in the vertical direction so that a control beam 33 sent by a transmitter 32*a* extends slightly acute-angled (angle 34) relative to the respective adjacent folding edge 35 of the layers 21 of the web of material 10. This ensures that each control beam 33 at the most crosses one folding edge 35, which is thus monitored by the receiver 32*b*. Consequently, it is possible by means of the sensors 32*a* and *b* to find the number of layers 21 of the web of material 10 in the reservoir housing 20, at least of those layers 21, which form a stack of layers as a result of the dead weight of the web of material 10.

Folding the web of material 10 in a zig-zag manner and forming layers is particularly easy with web of materials which have already been divided into individual blanks being still linked to one another via residual connections, because the web of material 10 is weakened in the region of these residual connections in such a way that a folding edge 35 can easily be formed here, so that each layer 21 is formed by one blank.

Figure 7:
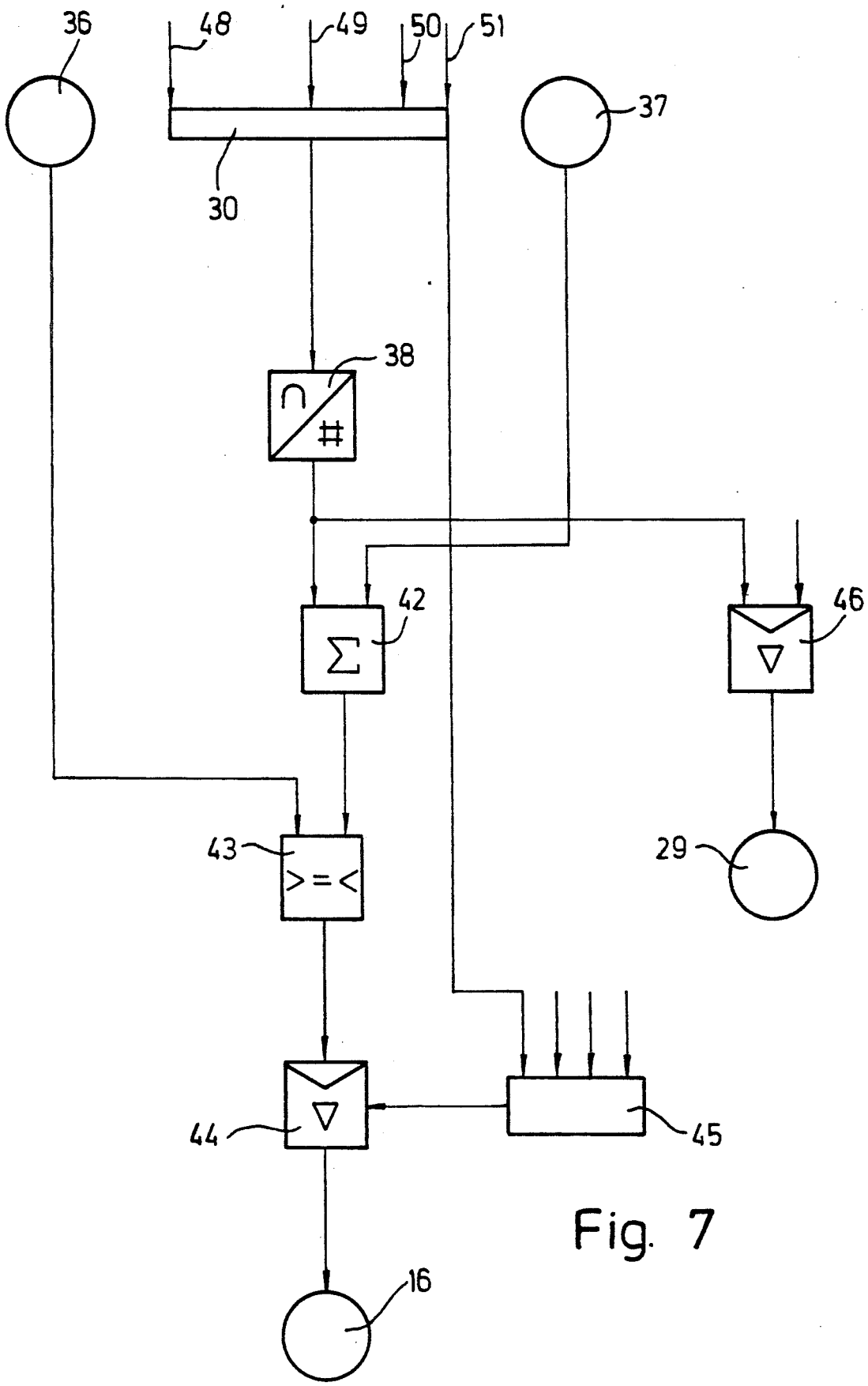
FIG. 7 shows a block diagram of a first embodiment of a control system of an apparatus according to the invention, mostly working in an analog manner.
Figure 8:
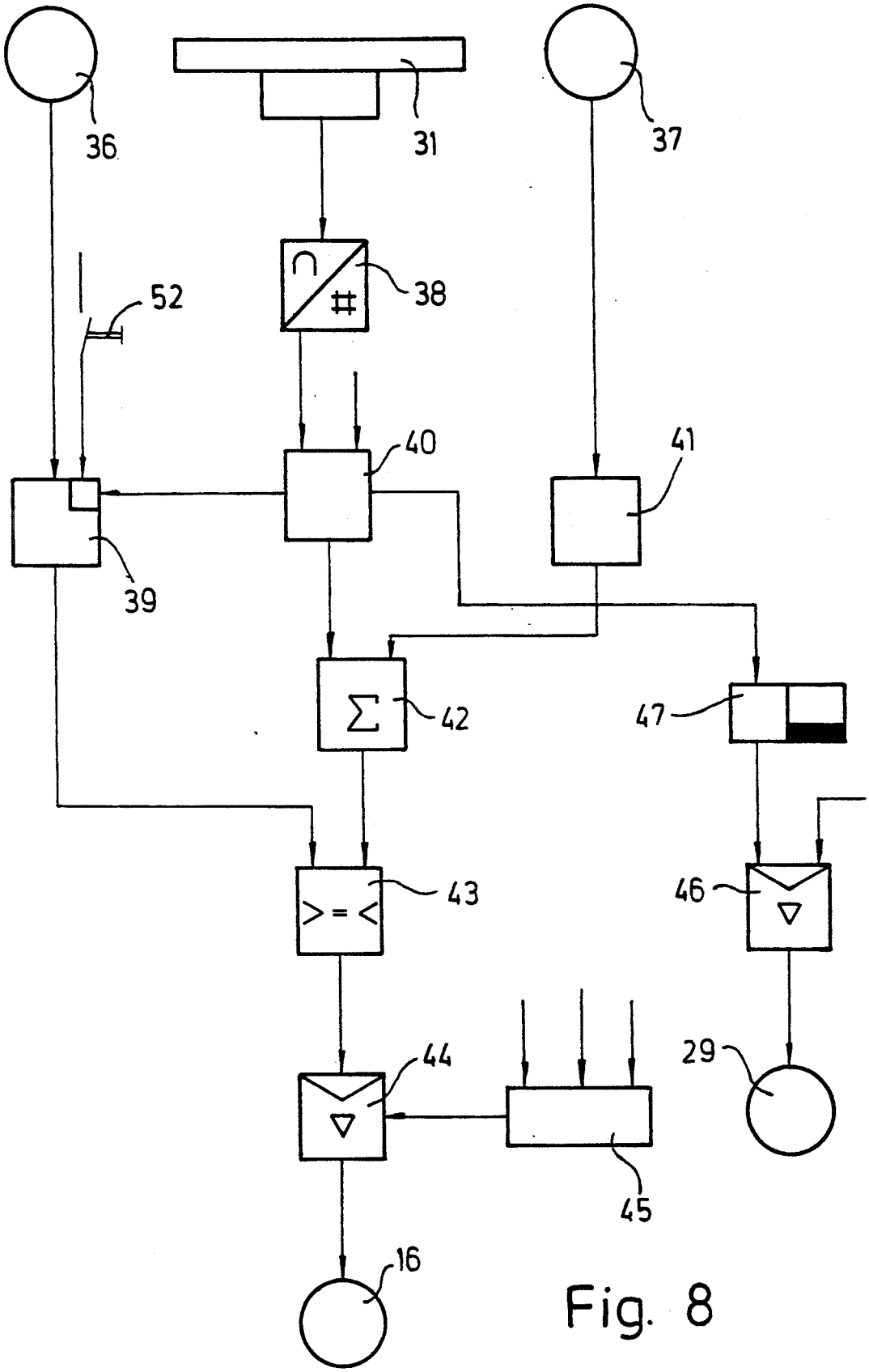
FIG. 8 shows a block diagram according to FIG. 7 of a second embodiment of a control system, mostly working in a digital manner.

FIGS. 7 and 8 show block diagrams for a control system of the feed apparatus according to the invention which controls the drive 16 of the reel 11. These control systems comprise the measuring means 30 and 31, respectively.

The control system according to FIG. 7 is mostly working in an analog manner, whereas the control system according to FIG. 8 is mostly working digitally. The first circuit has been assigned to a sensor measuring means 30 and the second circuit to a weighing measuring means 31, but the circuits could also be assigned the other way round.

Apart from the measuring means 30 or 31, the shown circuits also comprise rotational pulse generators 36 and 37 as signal transmitters which are assigned to the rollers 18 and 22.

The output signal of the measuring means 30 or 31 is transmitted to an analog to digital converter 38. In the digitally working circuit of FIG. 8, the signals of the rotational pulse generators 36 and 37 and the output signal of the analog to digital converter (ADC) are transmitted to counting devices 39 . . . 41. In the embodiment of FIG. 7, these signals are directly led further without counting devices.

The rotational pulse generator 37 of the drawing roller 22 and the measuring means 30 or 31 are connected to inputs of a summer 42. The output signal of the summer 42 and the output signal of the rotational pulse generator 36 of the pushing roller 18 are transmitted to the inputs of a comparator 43. The output signal of the comparator 43 is transmitted to a speed governor 44 which regulates the motor drive 16 of the reel 11. Moreover, a motor (emergency) cut-out 45 is assigned to the motor drive 16 via the speed governor 44.

The output signal of the measuring means 30 or 31 is also transmitted to a speed governor 46, with which the drive means 20 of the pulling roller 22 is controlled. In the embodiment of FIG. 8, a release means 47 is arranged upstream of the speed governor 46.

FIG. 7 indicates four different filling level values 48 . . . 51 of the reservoir housing 20 at the measuring means 30. The mark 48 designates a minimum level, mark 49 an intermediate level, mark 50 a maximum level and mark 51 a complete filling of the reservoir housing 20. If this last mark 51 is reached, a signal is transmitted to the motor cut-out 45 for stopping the motor drive 16 of the reel 11.

The feed apparatus according to the invention, that is to say its control system, operates as follows:

The velocity of the drive, especially of the drive of a relatively heavy reel, is to be adjusted to the partly intermitting material consumption of a packaging machine, specifically with speed variations being as small as possible, that is to say with small accelerations.

As soon as the reel 11 or its drive 16 is started—for which a start switch 52 is provided in the embodiment of FIG. 8—, the press-on roller 19 is pressed against the pushing roller 18 and the press-on roller 23 against the drawing roller 22. The rotational pulse generators 36 and 37 of the pushing roller 18 and the drawing roller 22 transmit pulses when the rollers 18, 22 are moving, preferably 1000 pulses per revolution, so that the the rotary movement of the rollers 18. 22 is quantitatively determined. On the basis of this rotary movement, it can be determined, how much material is fed into the reservoir housing 20 and how much material is taken out of the reservoir housing 20. Herewith, the reservoir filling of the reservoir housing 20 is calculated.

Moreover, the reservoir filling of the reservoir housing 20 is additionally determined by the measuring means 30 or 31. Both measurements are combined via the summer 42.

When the apparatus is first started and the reservoir is still empty, only the reel 11 and the pushing roller 18 are driven, not the drawing roller 22, until the intermediate mark 49 has been reached. At this reservoir level, the discharge of the material can be started at a relatively high acceleration and the reel can be adjusted to the consumption speed at a relatively low acceleration, without the reservoir running empty.

As soon as the intermediate mark 49 is reached, the drive means 29 for the drawing roller 22 is started and thus the discharge or outflow from the reservoir housing 20 released. Thereafter, the drive 16 of the reel 11 is operated in dependence on the filling level of the reservoir housing 20, specifically within the marks 48 and 50 for the minimum and maximum level. If the reservoir level falls below the intermediate mark 49, the velocity of the reel 11 is increased to the extent of the drop below this mark, until the level again reaches or exceeds the mark 49. If the reservoir level goes above the mark 49, the reel is slowed down to a corresponding extent. Thus it is ensured that the reservoir level is mostly kept in the region of the intermediate mark 49.

Preferably, the variable part of the velocity of the reel 11 is added to a basic velocity of the reel.

If the minimum mark 48 is reached, the drive 29 of the drawing roller 22 for the discharge of the material is switched off. If, on the other hand, the maximum mark 50 is reached and exceeded, the drive 16 of the reel 11 switches to a crawling speed until the mark 51 indicating complete filling of the reservoir housing 20 is reached. If there is (still) no discharge of the material out of the reservoir housing 20 when this mark 51 is reached, the drive 16 cuts out via the motor cut-out 45.

Motor stops via the motor cut-out 45 may for instance also be provided for emergency situations such as a tearing of the web of material or the like.

What is claimed is:

1. A process for controlling the drive of a reel of a continuous web of packaging material from which blanks are successively severed and fed to a packaging machine, said processing comprising the steps of:

forming a material reservoir of the web (10) of material by folding the web in a zig-zag manner in a reservoir housing (20);

continuously determining filling of the material reservoir;

in response to the filling of the material reservoir, controlling driving of the reel so that the reservoir filling does not fall below a minimum reservoir level and does not exceed a maximum reservoir level;

wherein said determining step comprises comparing the amount of material fed into the reservoir and the amount discharged from the reservoir;

wherein said controlling step comprises controlling a variable drive speed of the reel (11) in response to a result of said comparing step;

conveying the web of material into and out of the material reservoir by means of feeding rollers and discharge rollers, respectively, and measuring the number of revolutions of the feeding rollers as well as of the discharging rollers for determining the reservoir filling providing a first signal which is generated by a signal generator associated with said feeding rollers and which corresponds to a quantity of conveying movement of said feeding rollers;

providing a second signal which is generated by a second signal generator associated with said discharging rollers;

providing a third signal representing the reservoir filling;

comparing the first signal to said second and third signals; and using the result of the comparison to control the driving of the reel.

2. An apparatus for feeding to a packaging machine a web of packaging material from which blanks are to be successively severed, said apparatus comprising:

a packaging machine, a reel-drive motor (16) for driving a reel of the web of material to unwind the latter from the reel;

a material reservoir through which the unwound web of material is conveyable;

a motor control system which comprises determining means for continuously determining the reservoir filling and for controlling the motor (16) in response to the continuously determined reservoir filling so that said filling does not fall below a minimum reservoir filling and does not exceed a maximum filling; and conveying means for feeding the web of material (10) into the reservoir (20) and for discharging said web of material (10) out of the reservoir (20);

wherein said determining means comprise: first measuring means (36, 37) which are assigned to said conveying means for measuring feeding-in and discharging-out amounts of material; and a comparing device (43) which compares the respective fed-in and discharged amounts of material with one another for determining the reservoir filling, said conveying means comprising feeding-in and discharging-out rollers (18, 19 and 22, 23), and said first measuring means comprising roller-revolution counter means (36, 37);

wherein the determining means comprise at least one second measuring means (30, 31) which is assigned to said material reservoir (20) and measures the reservoir filling;

discharge roller-drive means (29) responsive to a control member which is in operative connection with said second measuring means (30, 31) such that the discharge of material out of the material reservoir is released only if at least one predetermined intermediate reservoir filling (49), between the minimum and the maximum reservoir filling (48 and 50), is present, or such that, at least until the intermediate reservoir filling (49) is reached, discharge outflow is slower than feed inflow;

means for connecting an output of said first measuring means (36) and an output of said second measuring means (30, 31) to respective inputs of said comparing device (43); and means for connecting an output of said comparing device (43) to a speed control means (44) of said reel-drive motor (16).

3. The apparatus as claimed in claim 2, wherein said material reservoir comprises a reservoir housing (20) designed to hold the reservoir material (10) in zig-zag-shaped layers (21), and wherein said second measuring means (30) is designed to determine the number of layers (21) in reservoir housing (20).

4. The apparatus as claimed in claim 3, wherein the measuring means (30) comprises a plurality of sensors (**32*a, b*) which are arranged next to one another within the housing (20) for scanning the number of layers (21) of the zig-zag-shaped web of material (10**).

5. The apparatus as claimed in claim 4, wherein said sensors comprises pairs of corresponding transmitters and receivers which are slightly offset to one another in a vertical direction, so that control beams (33) of the transmitters are each directed at an acute angle to planes of layers (21) of the web of material (10).

6. The apparatus as claimed in claim 3, wherein the reservoir housing (20) of the web of material is box-shaped and has a tongue-shaped runout member (25), and wherein the conveying means is a conveying rollers (18, 19 and 22, 23) and has a recess (26) into which a free end of the tongue-like runout member (25) projects.

7. An apparatus for feeding to a packaging machine a web of packaging material from which blanks are to be successively severed, said apparatus comprising:

a packaging machine;

a reel-drive motor (16) for driving a reel of the web of material to unwind the latter from the reel;

a material reservoir through which the unwound web of material is conveyable; and a motor control system which comprises determining means for continuously determining the reservoir filling and for controlling the motor (16) in response to the continuously determined reservoir filling so that said filling does not fall below a minimum reservoir filling and does not exceed a maximum filling;

wherein said determining means comprises at least one measuring means (30, 31) which is assigned to said material reservoir (20) and which measures the reservoir filling;

wherein said material reservoir comprises a reservoir housing (20) designed to hold the reservoir material (10) in zig-zag-shaped layers (21), and wherein said measuring means (30) is designed to determine the number of material layers (21) in said reservoir housing (20);

wherein said measuring means (30) comprises a plurality of sensors (32*a, b*) which are arranged next to one another within the housing (20) for scanning the number of layers (21) of the zig-zag-shaped web of material (10);

wherein said sensors comprise pairs of corresponding transmitters and receivers which are slightly offset to one another in one direction so that control beams (33) of the transmitters are each directed at an acute angle to planes of the layers (21) of the web of material (10).

8. A process for controlling the drive a reel of a continuous web of packaging material from which blanks are successively severed and fed to a packaging machine, said process comprising the steps of:

forming a material reservoir of the web (10) of material by folding the web in a zig-zag manner in a reservoir housing (20);

continuously determining filling of the material reservoir;

in response to the filling of the material reservoir, controlling driving of the reel so that the reservoir filling does not fall below a minimum reservoir level and does not exceed a maximum reservoir level;

wherein said determining step comprises comparing the amount of material fed into the reservoir and the amount discharged from the reservoir;

wherein said controlling step comprises controlling a variable drive speed of the reel (11) in response to a result of said comparing step; and determining the number of layers of the web of material which are arranged next to one another for measuring the reservoir filling.

9. The process as claimed in claim 8, comprising scanning the amount of material in the material reservoir by means of sensors.

10. A process for controlling the drive of a reel of a continuous web of packaging material form which blanks are successively severed and fed to a packaging machine, comprising the following steps:

a) providing the web (10) of material in the form of continuously interconnected blanks made of thin cardboard and connected to one another by residual web connections containing perforations or weakenings;

b) forming the web (10) of material in a material reservoir by folding the web in a zig-zag manner in a reservoir housing (20) to be filled with the folded web;

c) folding the web (10) of material in said zig-zag manner along lines of said residual web connections;

d) continuously determining the filling of the material reservoir; and e) controlling the drive of the reel in response to the filling of the material reservoir, so that the reservoir filling level does not fall below a minimum reservoir level and does not exceed a maximum reservoir level;

f) wherein said determining step comprises determining the filling level of the material reservoir by comparing the quantity of material fed into the reservoir and discharged from the reservoir; and g) wherein said controlling step comprises variably controlling the drive speed of the reel (11) in response to the filling level of the material reservoir.

11. The process as claimed in claim 10, comprising conveying the web of material into and out of the material reservoir by means of feeding rollers and discharge rollers, respectively, and measuring the number of revolutions of the feeding rollers as well as of the discharging rollers for determining the reservoir filling.

12. The process as claimed in claim 10, comprising releasing the discharge of material out of the material reservoir only if at least one predetermined intermediate reservoir filling level, between said minimum and said maximum reservoir levels, is present.

13. The process as claimed in claim 12, comprising drawing the reel at a slow crawling speed if the filling level of the material reservoir reaches or exceeds a reservoir filling value predetermined as a maximum value.

14. Process for controlling the drive of a reel of a continuous web of packaging material from which blanks are successively severed and fed to a packaging machine, comprising the following steps:

a) providing the web (10) of material in the form of continuously interconnected blanks made of thin cardboard and connected to one another by residual web connections containing perforations or weakenings;

b) forming the web (10) of material in a material reservoir by folding the web in a zig-zag manner in a reservoir housing (20) to be filled with the folded web;

c) folding the web (10) of material in said zig-zag manner along lines of said residual web connections;

d) continuously determining the filling of the material reservoir; and e) controlling the drive of the reel in response to the filling of the material reservoir, so that the reservoir filling level does not fall below a minimum reservoir level and does not exceed a maximum reservoir level;

f) wherein said determining step comprises scanning the quantity of material present in the material reservoir with a plurality of pairs of optical transmitting and receiving sensors located along a dimension of the reservoir housing (20), and g) between the transmitting sensor and the receiving sensor of each pair, orienting an optical test beam at an acute angle relative to the plane of a respective layer of the zig-zag folded web in the material reservoir.

* * * * *